US009513587B2

(12) United States Patent
Uchida et al.

(10) Patent No.: US 9,513,587 B2
(45) Date of Patent: Dec. 6, 2016

(54) IMAGE FORMING APPARATUS AND IMAGE FORMING SYSTEM INCLUDING A DETECTION UNIT THAT DETECTS INFORMATION ABOUT A USED AMOUNT OF UNIT

(71) Applicant: CANON KABUSHIKI KAISHA, Tokyo (JP)

(72) Inventors: Wataru Uchida, Yokohama (JP); Satoru Taniguchi, Mishima (JP); Hiroyuki Yamazaki, Mishima (JP); Toshifumi Kitamura, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/613,742

(22) Filed: Feb. 4, 2015

(65) Prior Publication Data

US 2015/0227101 A1 Aug. 13, 2015

(30) Foreign Application Priority Data

Feb. 7, 2014 (JP) ..... 2014-022137
Jan. 15, 2015 (JP) ..... 2015-006004

(51) Int. Cl.
*G03G 15/00* (2006.01)

(52) U.S. Cl.
CPC ..... *G03G 15/553* (2013.01)

(58) Field of Classification Search
CPC ..... G03G 15/553; G03G 15/556
USPC ..... 399/111, 33, 122, 252, 27, 26
See application file for complete search history.

(56) References Cited

U.S. PATENT DOCUMENTS

| | | | | |
|---|---|---|---|---|
| 8,792,793 | B2 * | 7/2014 | Kawai et al. | |
| 2003/0200057 | A1 * | 10/2003 | Johnson et al. | |
| 2012/0033981 | A1 * | 2/2012 | Fukuta | 399/111 |
| 2012/0141156 | A1 * | 6/2012 | Chihara | |
| 2014/0105620 | A1 * | 4/2014 | Elloitt et al. | |

FOREIGN PATENT DOCUMENTS

| | | | | |
|---|---|---|---|---|
| JP | 2001343870 | A | | 12/2001 |
| JP | 200329584 | A | | 1/2003 |
| JP | 2008191599 | A | * | 8/2008 |
| JP | 2013225073 | A | | 10/2013 |
| JP | 201419085 | A | | 2/2014 |

* cited by examiner

*Primary Examiner* — Susan Lee
(74) *Attorney, Agent, or Firm* — Canon USA, Inc. IP Division

(57) ABSTRACT

An image forming apparatus includes a detection unit that detects information about a used amount of a unit, and a control unit that outputs information indicating that the unit is required to be replaced when the information about the detected used amount reaches a first predetermined threshold value, wherein the control unit changes the threshold value to a second threshold value according to information about the used amount when the unit is replaced.

20 Claims, 10 Drawing Sheets

IMAGE FORMING APPARATUS AND IMAGE FORMING SYSTEM INCLUDING A DETECTION UNIT THAT DETECTS INFORMATION ABOUT A USED AMOUNT OF UNIT

BACKGROUND

Field

Aspects of the present invention generally relate to an image forming apparatus, and to a method for using a replaceable unit in the image forming apparatus.

Description of the Related Art

An electrophotographic printer has been known as an example of an image forming apparatus that forms an image on a recording medium. One type of electrophotographic printer includes a process cartridge in which components, such as a photosensitive drum for forming an image, a charging unit for charging the photosensitive drum, and a developing unit for forming a toner image on the photosensitive drum, are integrally formed. This process cartridge is detachably attached to a main body of the printer. For example, when toner contained therein runs out, a user replaces the process cartridge with a new process cartridge. Further, there is also another type of printer that includes, besides the process cartridge, additional units that are also detachably attached to a main body of the printer, such as a fixing unit for fixing an image on a recording medium and a transfer unit for transferring an image onto a recording medium.

While a time when such units need to be replaced (hereinafter, referred to as "replacement time") is set based on the image quality of an image formed on a recording medium, an image defect is more likely to be detected in an image such as a graphic image than in a text image. Therefore, the replacement time is set with reference to the image quality of an image such as a graphic image so that the replacement is performed before occurrence of an image defect. Such a setting gives a high priority to image quality and is effective as a specification for printing an image having no image defect. However, while such a setting is made for the foregoing purpose, some users may determine that to keep using the unit without carrying out replacement, even though some image defect is detected in a graphic image. Even in such a case, the user is prompted to replace the unit although the user wants to keep using the unit.

In view of such circumstances, Japanese Patent Application Laid-Open No. 2001-343870 discusses an image forming apparatus that considers a usage state of the user when changing a notification timing of a unit replacement time.

In Japanese Patent Application Laid-Open No. 2001-343870, the user evaluates the image quality of an image formed on a recording medium. The user then performs settings by pressing a button of an operation unit of the image forming apparatus several times according to the evaluation result, thereby reflecting the evaluation result. Thus, the user repeats confirmation of the image quality and the operation several times, which can be burdensome.

SUMMARY

Aspects of the present invention are generally directed to an image forming apparatus capable of changing a replacement time of a unit according to a usage status of the unit while reducing the burden on a user to do so.

According to an aspect of the present invention, an image forming apparatus, to which a unit is detachably attached, includes a detection unit configured to detect information about a used amount of the unit, when an image forming operation is performed using the unit, and a control unit configured to output information indicating that the unit is required to be replaced, when the information about the used amount reaches a first threshold value, wherein the control unit changes the first threshold value to a second threshold value different from the first threshold value when the unit is replaced after the information exceeds the first threshold value, and a used amount of the unit corresponding to the second threshold value is greater than a used amount of the unit corresponding to the first threshold value.

Further features of the present disclosure will become apparent from the following description of exemplary embodiments with reference to the attached drawings.

DESCRIPTION OF THE EMBODIMENTS

Various exemplary embodiments will be described below with reference to the drawings. It is to be understood that the following exemplary embodiments are not intended to limit the scope of the present disclosure and that all combinations of features described in the exemplary embodiments are not necessarily essential to the technical solution provided by the present disclosure.

Figure 1:
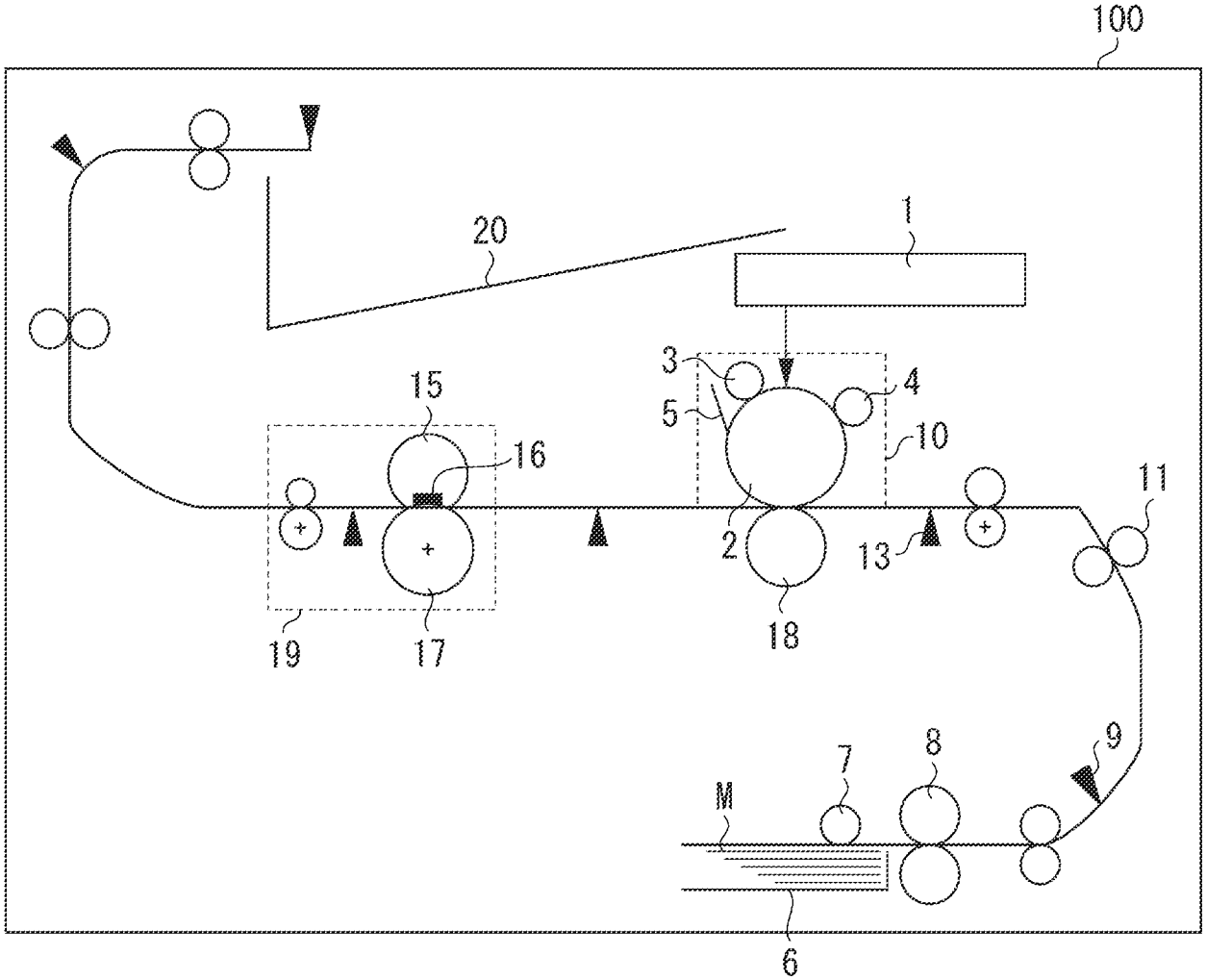
FIG. 1 is a schematic diagram illustrating a configuration of an image forming apparatus.

FIG. 1 is a schematic diagram illustrating a configuration of an image forming apparatus 100. A recording medium M stacked on a sheet feeding cassette 6 is fed by a sheet feeding roller 7. The recording medium M fed from the sheet feeding cassette 6 is conveyed by a conveyance roller 8, detected by a conveyance sensor 9, and then conveyed to a roller 11.

When the recording medium M is conveyed to a top sensor 13, a process cartridge 10 performs an image forming operation.

The process cartridge 10, serving as a unit detachably attached to the image forming apparatus 100, includes a photosensitive drum 2, a charging roller 3, a developing roller 4, and a cleaning blade 5. First, the charging roller 3 uniformly charges a surface of the photosensitive drum 2, and then a laser emitting unit 1 emits laser light onto the photosensitive drum 2, based on image information input to a controller of the image forming apparatus 100. The surface of the rotating photosensitive drum 2 is scanned with the laser light, so that an electrostatic latent image is formed thereon. Toner is supplied via the developing roller 4 to the electrostatic latent image formed on the photosensitive drum 2 so as to develop the electrostatic latent image as a toner image. Next, a transfer unit 18 transfers the toner image formed on the photosensitive drum 2 onto the conveyed recording medium M. After the toner image is transferred, the cleaning blade 5 cleans the toner remaining on the photosensitive drum 2. The recording medium M on which the toner image is transferred is then conveyed to a fixing unit 19.

The fixing unit 19 also serves as a unit detachably attached to an image forming apparatus. In this example, the fixing unit 19 includes a fixing film 15, a heater 16, and a pressing roller 17. The recording medium M is conveyed to a fixing nip portion formed by the fixing film 15 and the pressing roller 17. As a result, the toner image is fixed on the recording medium M. The recording medium M on which the toner image is fixed is discharged to a sheet discharge tray 20.

Figure 2:
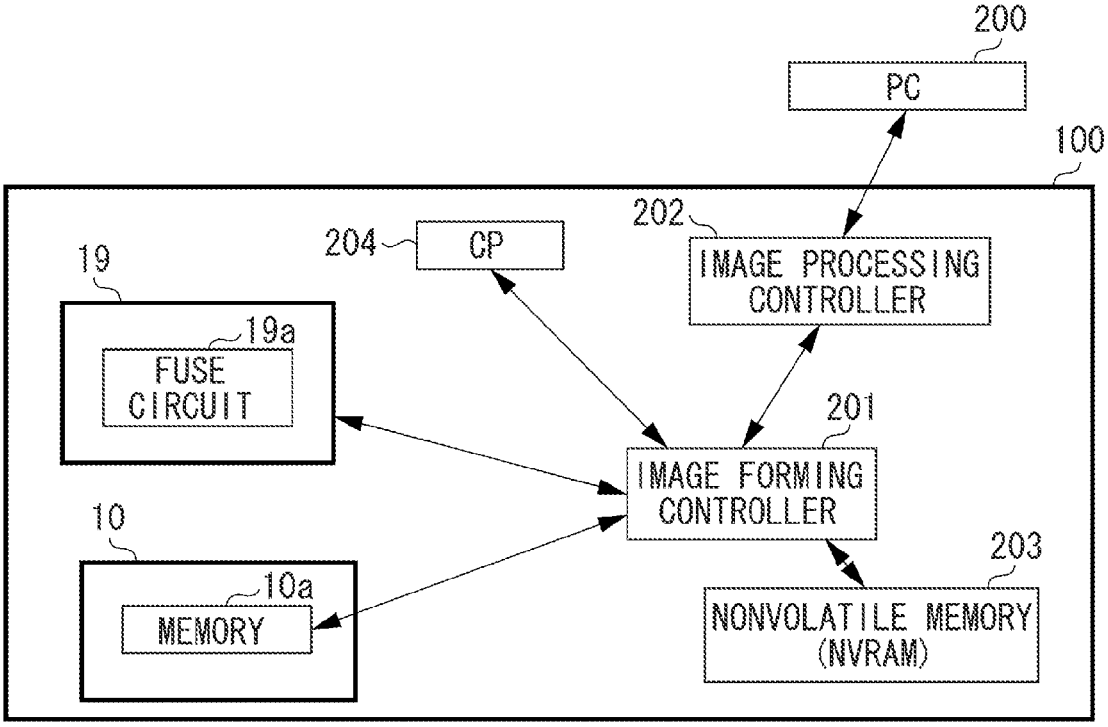
FIG. 2 is a block diagram of a system according to a first exemplary embodiment.

FIG. 2 illustrates a block diagram of an image forming system according to a first exemplary embodiment. The image forming system according to the present exemplary embodiment includes a personal computer (PC) 200 and the image forming apparatus 100. The image forming apparatus 100 is configured such that each of the process cartridge 10 and the fixing unit 19 is detachably attached to a main body of the image forming apparatus 100. The image forming apparatus 100 includes an image forming controller 201 and an image processing controller 202. The image forming controller 201 controls an image forming operation of the image forming apparatus 100. The image processing controller 202 receives job information transmitted from the PC 200, and performs processing of converting the job information into image information (hereinafter also referred to as "bitmap data"). The image forming apparatus 100 further includes a nonvolatile memory (hereinafter also referred to as "NVRAM") 203 that is readable and writable. The NVRAM 203 stores and holds data even after being powered off. The image forming apparatus 100 further includes a control panel (CP) 204 having a display unit for displaying that each of the fixing unit 19 and the process cartridge 10, each serving as a replaceable unit detachably attached to the image forming apparatus 100, is to be replaced, and for displaying a usage state of the unit. The CP 204 includes buttons serving as an operation unit, which allows a user to confirm or change various settings of the image forming apparatus 100.

The fixing unit 19 includes a fuse circuit (a fuse resistance element) 19*a* for detecting whether the fixing unit 19 is new, when the fixing unit 19 is attached to the main body. When the new fixing unit 19 is attached, an electric current flows through the fuse circuit 19*a*, so that a fuse blows. Once the fixing unit 19 is attached, the image forming controller 201 can determine whether the fuse is blown, i.e., whether the attached fixing unit 19 is new, by detecting a flowing current.

Further, the process cartridge 10 includes a memory 10*a* in which identification data (e.g., an ID number) for enabling individual identification is written. When the process cartridge 10 is attached, the image forming controller 201 reads the identification data from the memory 10*a* so as to detect whether the process cartridge 10 is new or has been previously attached. In addition, the memory 10*a*, which is a nonvolatile memory, can also update and then store information about a used amount of the process cartridge 10. If the information about the used amount is stored, image formation conditions can be controlled by recognizing the used amount of each of the individual process cartridge 10.

Figure 3:
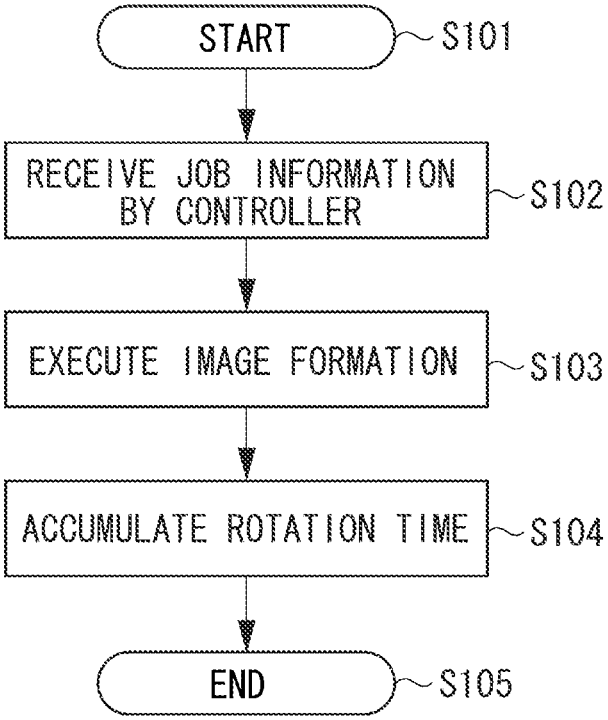
FIG. 3 is a flowchart according to the first exemplary embodiment.

Next, an operation for accumulating a drive time of the fixing unit 19 will be described based on a flowchart of FIG. 3. In step S101, a control operation begins. In step S102, job information transmitted from the PC 200 connected to the image forming apparatus 100 is input to (received by) the image processing controller 202. The image processing controller 202 converts the job information into image information by performing image processing, and transmits the image information to the image forming controller 201. In step S103, upon receiving the image information, the image forming controller 201 performs an image forming operation. When the image forming operation is performed, the fixing unit 19 is driven. In step S104, the image forming controller 201 counts the drive time of the fixing unit 19 taken for this image forming operation, as information about the used amount of the fixing unit 19, and accumulates the counted drive time. The accumulated drive time is updated and then stored in the NVRAM 203. Then, in step S105, the control operation ends. In the present exemplary embodiment, the drive time is counted as a parameter for notification of the replacement time of the fixing unit 19. However, the number of rotations of the fixing unit 19 may be accumulated. In such a case, the number of rotations can be calculated using a rotation time of a motor (not illustrated) that drives the fixing unit 19. These control operations are performed by the image forming controller 201 and the image processing controller 202 based on a program stored beforehand in a read-only memory (ROM) (not illustrated).

Figure 4:
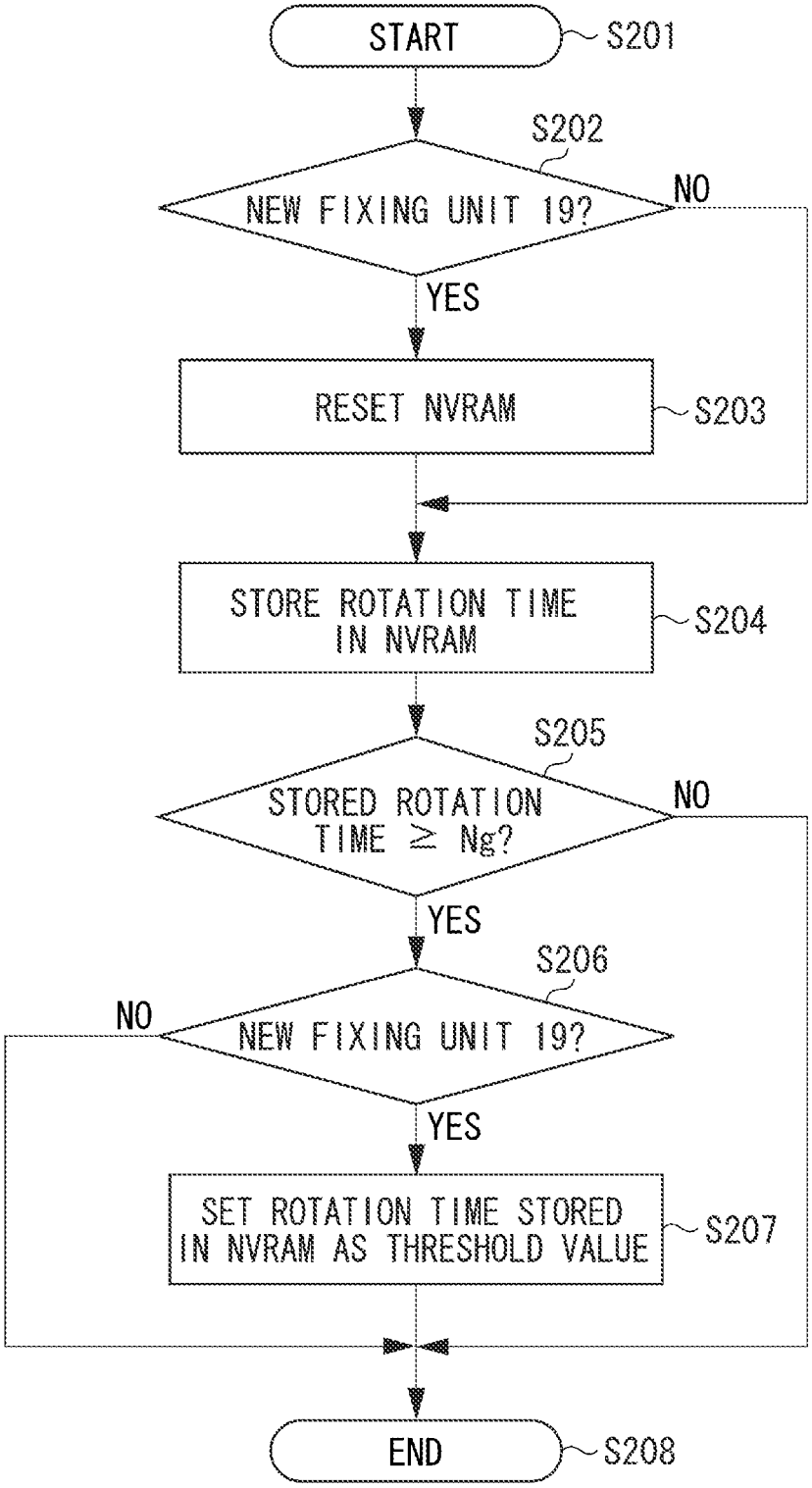
FIG. 4 is a flowchart according to the first exemplary embodiment.

FIG. 4 is a flowchart illustrating an operation for calculating the number of rotations (an accumulation value) to be used in the next notification of the replacement time of the fixing unit 19, after the one notification of the replacement time of the fixing unit 19. In step S201, a control operation begins. In step S202, whether the fixing unit 19 is new is detected by detecting a current value of a current flowing through the fuse circuit 19*a*, each time the image forming apparatus 100 is turned on. If the fixing unit 19 is detected as a new one (Yes in step S202), then in step S203, the drive time stored in the NVRAM 203 is reset. Subsequently, in step S204, the drive time is updated and then stored in the NVRAM 203 by performing the control operation described with reference to FIG. 3, each time the image forming operation is performed. Next, in step S205, it is determined whether the drive time stored in the NVRAM 203 is greater than or equal to a threshold value Ng. The threshold value Ng is a threshold value at which an image defect may occur in a graphic image. As the drive time accumulates, the fixing unit 19 gradually deteriorates, so that the density of an image fixed on a sheet becomes more likely to vary. The threshold value Ng indicates a threshold value at which, when a standard graphic image is fixed, the density of the image may vary if the drive time becomes greater than or equal to an Ng time. This threshold value Ng is obtained beforehand by experiment and set (stored in a memory such a ROM (not illustrated), and read by a central processing unit (CPU) for comparison).

If the drive time is less than the threshold value Ng (No in step S205), the accumulated drive time is stored in the NVRAM 203, and then in step S208, the control operation ends. On the other hand, if the drive time is greater than or equal to the threshold value Ng (Yes in step S205), then in step S206, whether the fixing unit 19 is replaced with a new one is detected. In step S206, the detection can be performed by detecting a change in the electric current flowing through the fuse circuit 19*a* as described above. If it is determined that the fixing unit 19 is replaced with a new one (Yes in step S206), then in step S207, the drive time at that moment is stored in the NVRAM 203, as a drive time at the time of replacement. The drive time at the time of replacement that is stored in the NVRAM 203 is then set as the next threshold value. Since the fixing unit 19 has been replaced, the processing returns to step S203, so that the accumulated drive time stored so far in the NVRAM 203 is reset and the drive time is newly accumulated and stored. In this way, each time the fixing unit 19 is replaced, the threshold value Ng for detecting the replacement time is changed. As a result, the notification of the replacement time can be issued depending on a usage status of the user. The notification of the replacement time can be issued by displaying, on the CP 204, a message (such as "Please replace unit.") indicating that the unit needs to be replaced, as information indicating the replacement time. For an apparatus having no display unit, the apparatus can be controlled to display the information on a screen of a connected PC.

Figure 5:
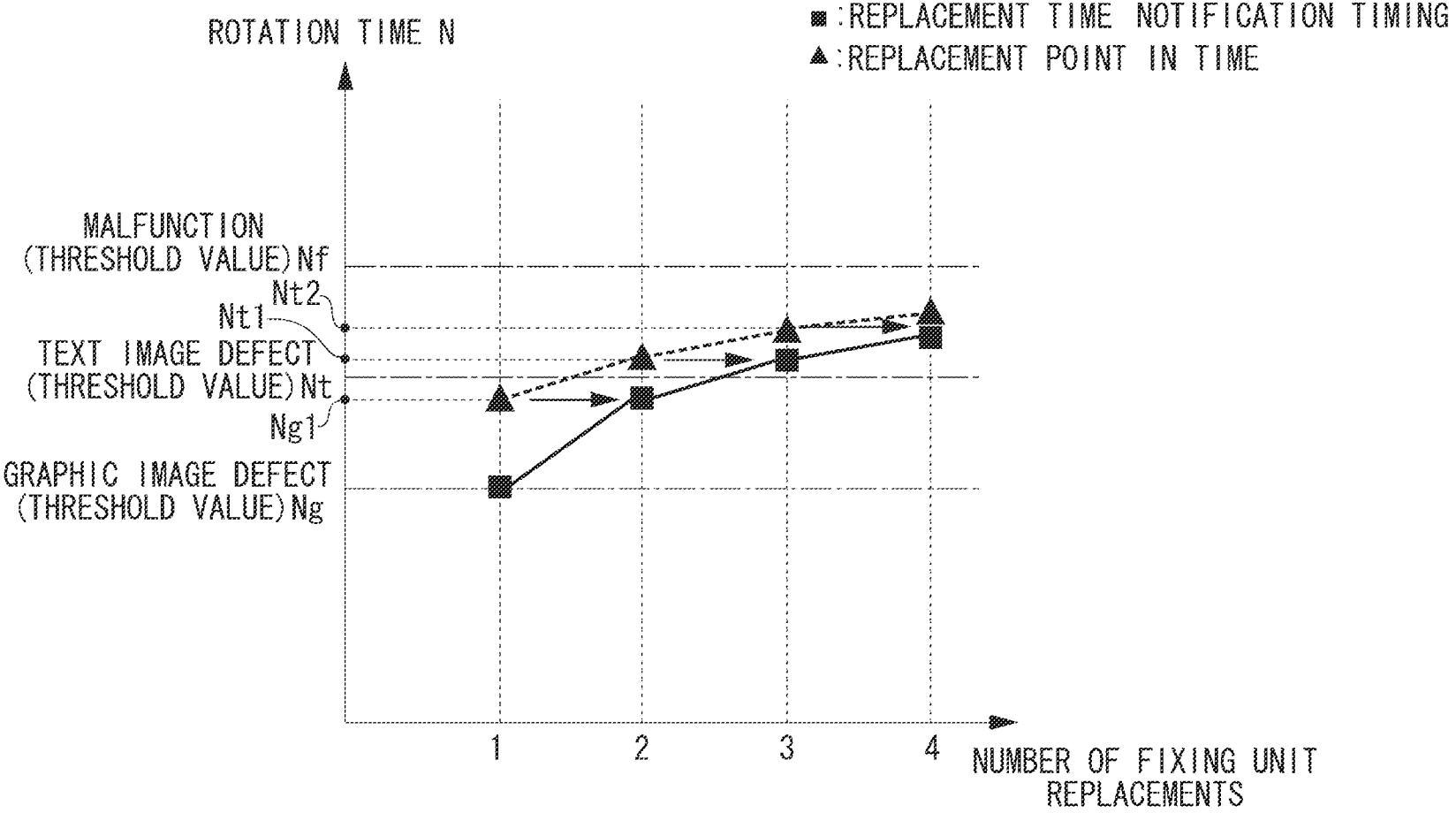
FIG. 5 illustrates a first example of a relationship between a rotation time obtained when a fixing unit is replaced, a rotation time obtained when a user is notified that the fixing unit needs to be replaced, and the number of fixing unit replacements, according to the first exemplary embodiment.

A characteristic operation of an exemplary embodiment will be described based on FIG. 5. FIG. 5 illustrates a first example of settings of a threshold value for the user determining the replacement time of the fixing unit 19, and notification timing. In FIG. 5, a vertical axis represents a rotation time N, and a horizontal axis represents the number of times the fixing unit 19 is replaced. For the rotation time N, three threshold values obtained from experimental results are set beforehand and stored in the NVRAM 203, as the threshold values at which an image defect occurs. A threshold value Nf indicates a rotation time at which a malfunction such as a conveyance failure may occur. A threshold value Nt indicates a rotation time at which an image defect may occur for the case of fixing a text image. Further, a threshold value Ng indicates a rotation time at which an image defect may occur for the case of fixing a graphic image.

Each black-filled square "■" indicates a rotation time obtained when the user is notified via the CP 204 that the fixing unit 19 needs to be replaced, and a rotation time to be set as a threshold value. Each black-filled triangle indicates a rotation time obtained when the user replaces the fixing unit 19. In this example, the difference between the black-filled square "■" and the black-filled triangle decreases as the number of times the fixing unit 19 is replaced increases. As a result, the timing at which the user needs to replace the fixing unit 19 is variably set according to the timing at which the user replaces the fixing unit 19. From this, it can be observed that the replacement time of the fixing unit 19 is set to come later. In other words, as the number of fixing unit replacements increases, the fixing unit 19 can be used longer.

In first replacement of the fixing unit 19, information for informing the user that the fixing unit 19 needs to be replaced is displayed on (output to) the CP 204, when the rotation time reaches the rotation time Ng serving as an initial threshold value. However, the user actually replaces the fixing unit 19 at a rotation time Ng1, which is after the rotation time Ng and immediately before the rotation time Nt.

In second replacement of the fixing unit 19, information for informing the user that the fixing unit 19 needs to be replaced is displayed on (output to) the CP 204, when the rotation time of the fixing unit 19 reaches the rotation time Ng1 at which the user has replaced the fixing unit 19 for the first time. However, the user actually replaces the fixing unit 19 at a rotation time Nt1 which is slightly after the rotation time Nt.

In third replacement of the fixing unit 19, information for informing the user that the fixing unit 19 needs to be replaced is displayed on (output to) the CP 204, when the rotation time of the fixing unit 19 reaches the rotation time Nt1 at which the user has replaced the fixing unit 19 for the second time. However, the user actually replaces the fixing unit 19 at a rotation time Nt2 which is slightly after the rotation time Nt1.

In fourth replacement of the fixing unit 19, information for informing the user that the fixing unit 19 needs to be replaced is displayed on (output to) the CP 204, when the rotation time of the fixing unit 19 reaches the rotation time Nt2 at which the user has replaced the fixing unit 19 for the third time. At this time, the rotation time Nt2 and a replacement timing are substantially the same.

In this way, the rotation time obtained when the user has replaced the fixing unit 19 last time is set as the threshold value for notification of the next replacement. As a result, the replacement time can be optimized according to the usage status of the user. Accordingly, the fixing unit 19 can be replaced according to the usage status of the user.

Figure 6:
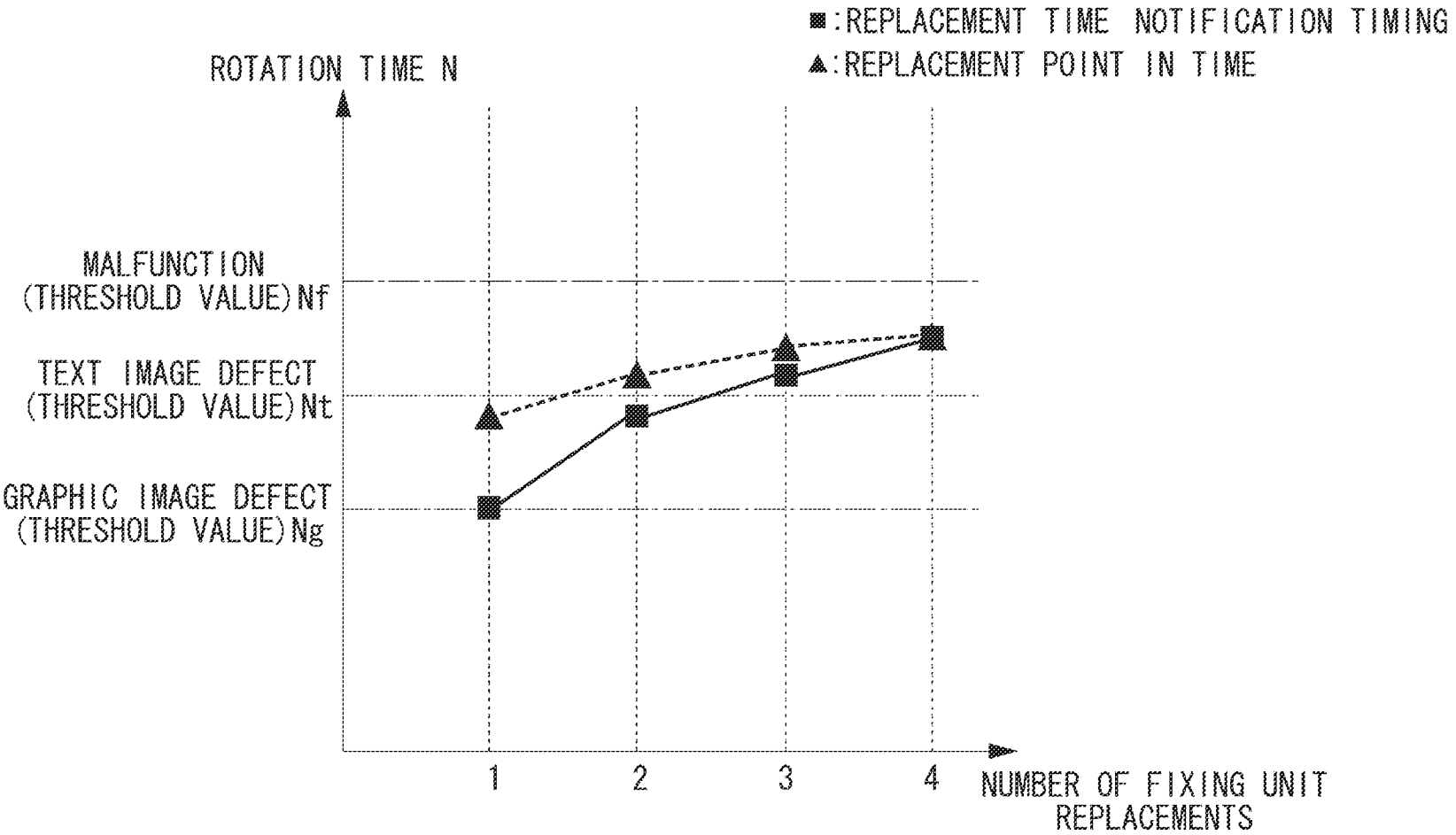
FIG. 6 illustrates a second example of a relationship between a rotation time obtained when the fixing unit is replaced, a rotation time obtained when the user is notified that the fixing unit needs to be replaced, and the number of fixing unit replacements, according to the first exemplary embodiment.

FIG. 6 illustrates, as a second example, a plot of the rotation time obtained when the user has replaced the fixing unit 19, the rotation time obtained when the user is notified that the fixing unit 19 needs to be replaced, and the number of times the fixing unit 19 is replaced, according to the present exemplary embodiment.

In the second example, logarithmic approximation is performed based on information about a plurality of rotation times obtained when replacement is performed a plurality of times (first to third replacements), so that a fourth threshold value is estimated and then set. The replacement time of the user can be precisely predicted by thus performing the logarithm approximation. Therefore, the user replaces the fixing unit 19 at the timing when the user is notified for the fourth time that the fixing unit 19 needs to be replaced.

As described above with reference to the first and second examples, the feature of the present exemplary embodiment lies in that the threshold value for notification of the next replacement time is set considering the accumulated time of the fixing unit at the previous replacement.

The fixing unit 19 has been described above as an example of a detachable unit. However, in replacement of the process cartridge 10 as well, the replacement time can be set according to the usage status of the user by performing similar control. In the case of using the process cartridge 10, the replacement of the process cartridge 10 can be detected using a memory provided in the process cartridge 10. In other words, information indicating that the process cartridge 10 is new may be stored in the memory, and the information may be reset when the process cartridge 10 is attached. As a parameter relating to the replacement time, parameters such as a rotation time of the photosensitive drum 2 and a remaining amount of the contained toner can be used. When the transfer unit 18 is configured so as to be replaceable with respect to the main body, similar control can be executed for replacement of the transfer unit 18.

Figure 7:
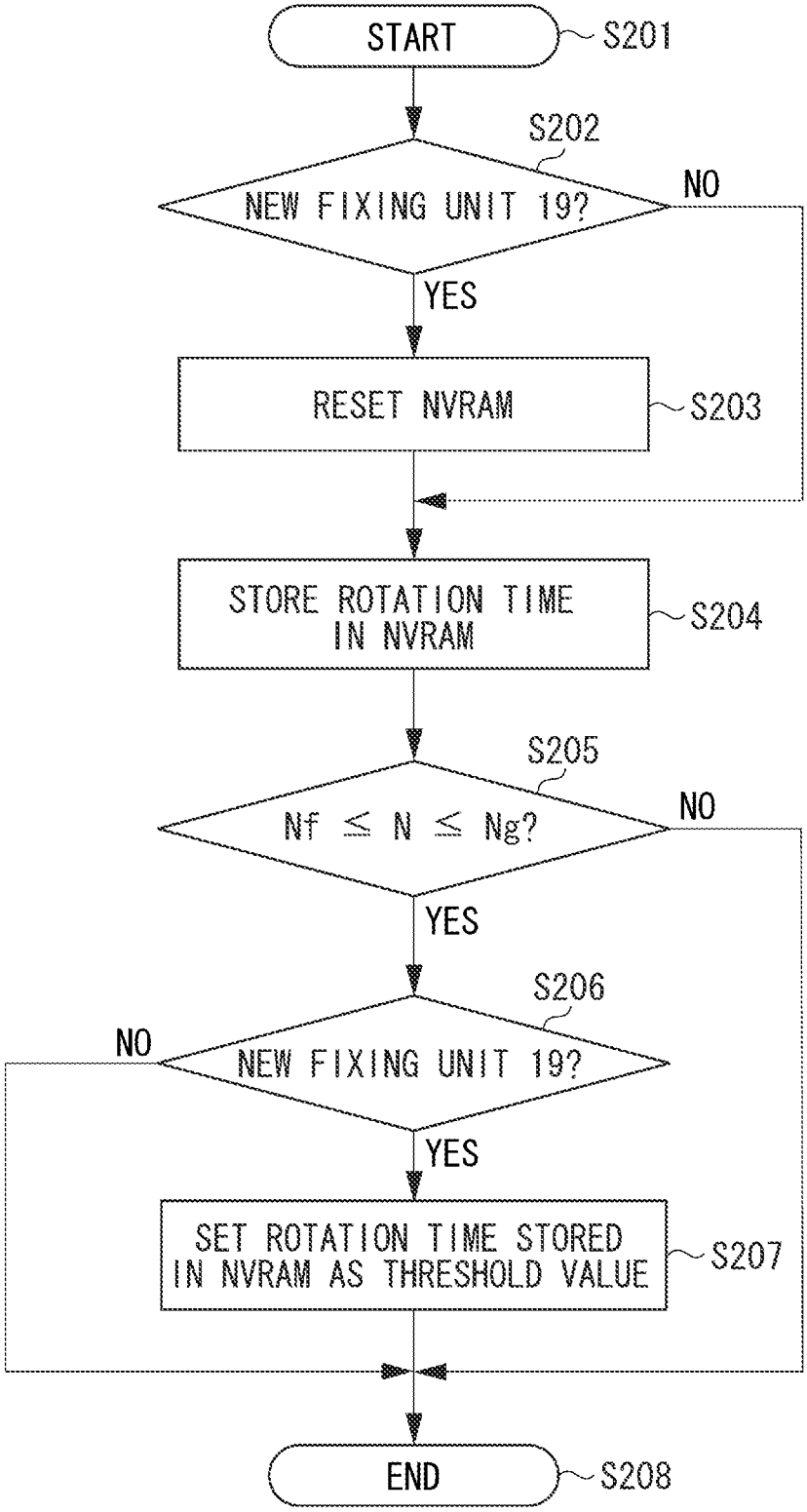
FIG. 7 is a flowchart according to another exemplary embodiment.

As illustrated in FIG. 7, control can also be performed so as to store a rotation time obtained when the user is notified that the fixing unit 19 needs to be replaced next time. A flowchart of FIG. 7 is different from the algorithm of the first exemplary embodiment illustrated in FIG. 4 in that "Nf≤N≤Ng" is added as a condition for storing the rotation time of when the user replaces the fixing unit 19. It is sufficient that the condition used in step S205 in FIG. 4 is replaced with this condition. For example, in any case except when the user replaces the fixing unit 19 for a reason other than the occurrence of an image defect, the replacement time of the fixing unit 19 can be estimated. This can further improve precision of the estimation of the replacement time.

Figure 8:
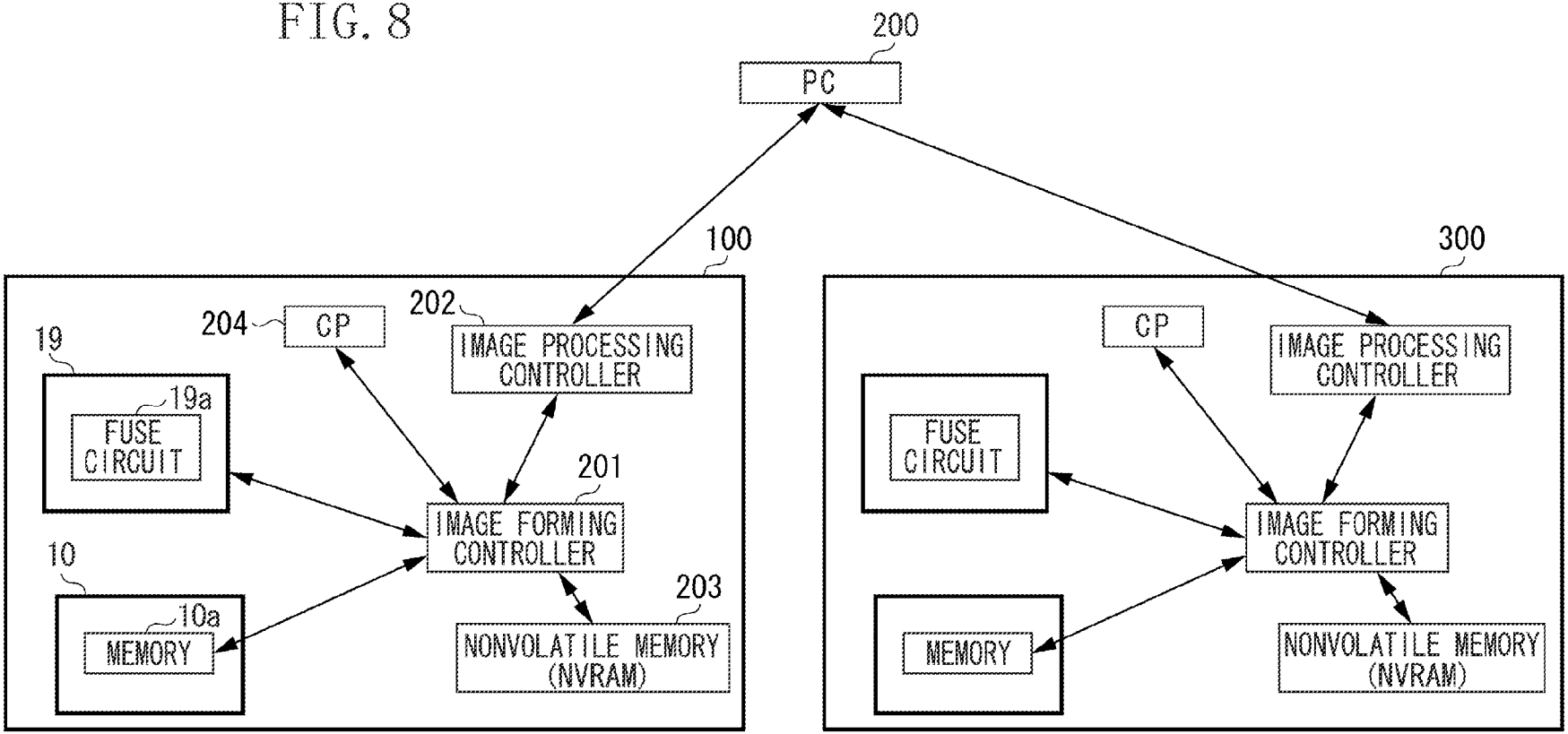
FIG. 8 is a block diagram of a system according to yet another exemplary embodiment.

FIG. 8 illustrates an image forming system including a plurality of image forming apparatuses and a computer (hereinafter also referred to as "PC"). As illustrated in FIG. 8, the system can be configured in such a manner that, for example, a system administrator can set a value in an NVRAM 203 via a CPU of each of image forming apparatuses 100 and 300, from a PC 200 serving as an external device. In this way, information about each image forming apparatus can be stored and managed in the PC 200, in a configuration in which a plurality of image forming apparatuses are connected.

Figure 9:
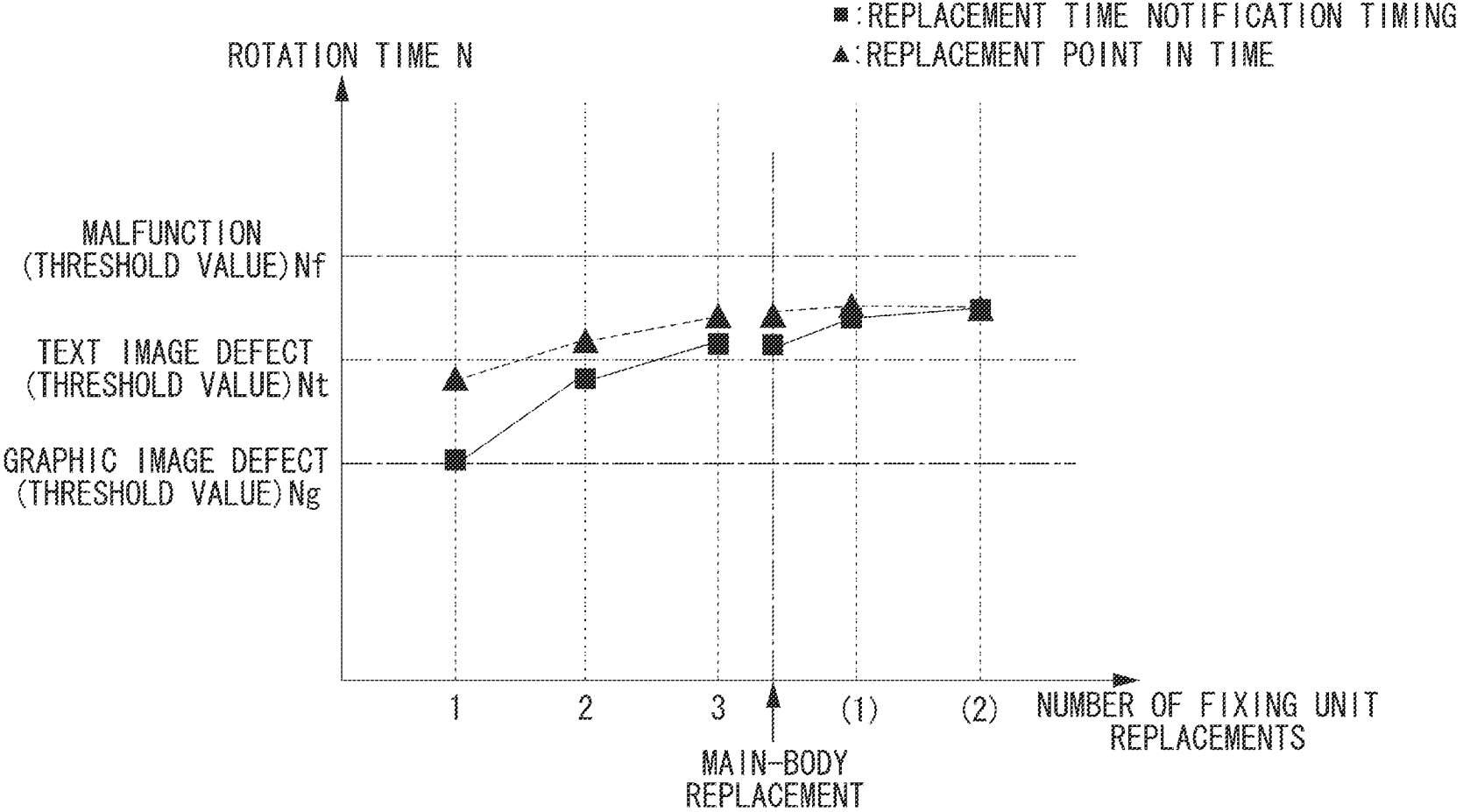
FIG. 9 illustrates an example of a relationship between a rotation time obtained when a fixing unit is replaced, a rotation time obtained when a user is notified that the fixing unit needs to be replaced, and the number of fixing unit replacements, according to yet another exemplary embodiment.

For example, FIG. 9 illustrates an example of a relationship between a threshold value of a rotation time obtained when a notification of the replacement of the fixing unit 19 is issued, and the number of times the fixing unit 19 is replaced, in a case where the main body of the image forming apparatus 100 is replaced.

The difference between the first exemplary embodiment illustrated in FIG. 2 and this example lies in that the main body of the image forming apparatus 100 is replaced after the fixing unit 19 is replaced three times. The system administrator can write information (threshold value information) about the rotation time obtained when the user replaces the fixing unit 19, in an NVRAM of the main body of a new image forming apparatus.

Figure 10:
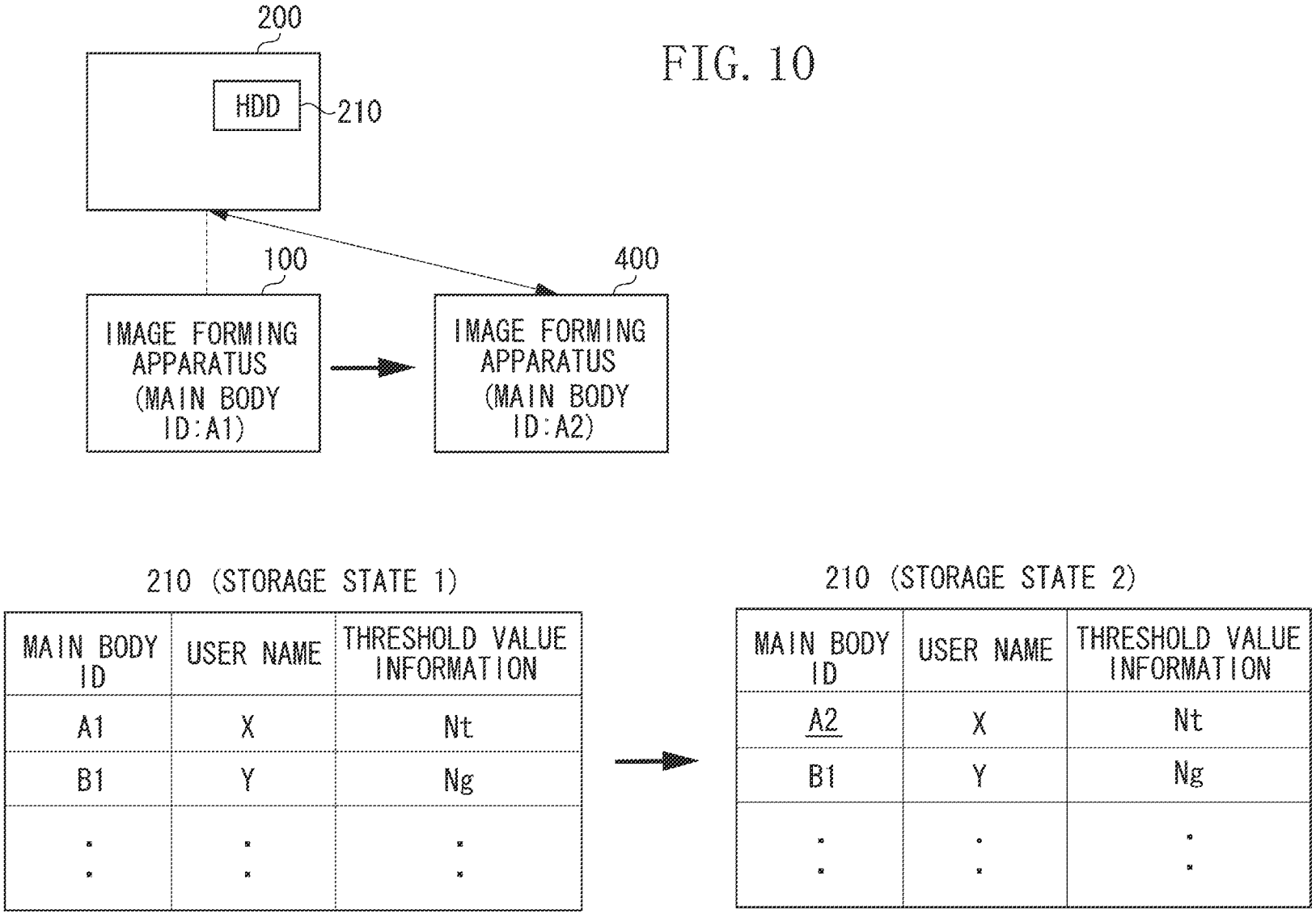
FIG. 10 is a diagram illustrating a system configuration and a storage state of a computer, according to yet another exemplary embodiment.

FIG. 10 illustrates an update state of a memory content in a storage unit (e.g., a hard disk drive (HDD)) 210 of the PC 200, in a case where the image forming apparatus 100 is replaced with a new image forming apparatus 400. In FIG. 10, for example, a main body ID (A1) of the image forming apparatus 100, user information (a user name), and threshold value information are associated with one another and stored in the storage unit 210 of the PC 200 connected to the image forming apparatus 100. In FIG. 10, in a state of the image forming apparatus 100 being in use, the main body ID: A1, the user name: X, and the threshold value information: Nt are stored (a storage state 1). After the image forming apparatus 100 is replaced with the image forming apparatus 400, the main body ID is updated to A2. Specifically, after the main body of the image forming apparatus 100 is replaced with the main body of the new image forming apparatus 400, the image forming apparatus 400 transmits user information (X) and a main body ID (A2), so that the main body ID is updated. Subsequently, the PC 200 writes the threshold value information Nt in an NVRAM of the main body of the new image forming apparatus 400. An image forming controller of the new image forming apparatus 400 determines the replacement time of a unit based on the threshold value information Nt stored in the NVRAM.

Accordingly, at the second replacement of the fixing unit 19, the rotation time obtained when the user replaces the fixing unit 19 and the rotation time obtained when the user is notified that the fixing unit 19 needs to be replaced can be matched with each other. In other words, the precision of estimating the replacement time of the fixing unit 19 can be quickly improved, and the period of using the fixing unit 19 can be adjusted according to the usage status of the user. Moreover, the system administrator can write an arbitrary rotation time in the NVRAM of the main body of the image forming apparatus and thus, the replacement time of the fixing unit 19 can be estimated not only in a single image forming apparatus but also in a plurality of image forming apparatuses.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Applications No. 2014-022137 filed Feb. 7, 2014 and No. 2015-006004 filed Jan. 15, 2015, which are hereby incorporated by reference herein in their entirety.

What is claimed is:

1. An image forming apparatus to which a unit that is used for image formation is detachably attached, the image forming apparatus comprising;

an image forming unit configured to form an image using the unit;

a controller configured to control an operation of the image forming unit;

a detection unit configured to detect information about a used amount of the unit an output unit configured to output information indicating that the unit is required to be replaced, when the information about the used amount reaches a first threshold, and a setting unit configured to, in a case where the unit is used after the information about the used amount reaches the first threshold and is replaced by a new unit, change the first threshold to a second threshold based on information about a used amount of the unit when the unit has been replaced by the new unit, the second threshold is larger than the first threshold, wherein image quality of an image formed on a recording material when the information about the used amount reaches the first threshold is different from image quality of an image formed on a recording material when the information about the used amount reaches the second threshold.

2. The image forming apparatus according to claim 1, wherein the setting unit sets, as the second threshold, the information about the used amount of the unit when the unit replaced by the new unit.

3. The image forming apparatus according to claim 1, wherein the controller estimates a replacement time of a newly attached unit based on information about a plurality of used amounts when the unit is replaced a plurality of times.

4. The image forming apparatus according to claim 1, wherein the information about the used amount is a drive time of the unit.

5. The image forming apparatus according to claim 1, wherein the unit is a fixing unit for fixing an image formed on a recording medium.

6. The image forming apparatus according to claim 1, wherein the unit is a cartridge including an image bearing member on which an image is to be formed.

7. The image forming apparatus according to claim 1, further comprising a storage unit configured to accumulate and store the information about the used amount, wherein the controller deletes the information stored in the storage unit when the unit is replaced.

8. The image forming apparatus according to claim 1, wherein the image quality of an image formed on a recording material when the information about the used amount reaches the first threshold corresponds to a graphic image and the image quality of an image formed on a recording material when the information about the used amount reaches the second threshold corresponds to a text image.

9. The image forming apparatus according to claim 8, wherein the first threshold is a value that a density of the graphic image is changed, and the second threshold is a value that a density of the text image is changed.

10. An image forming system including an image forming apparatus to which a unit that is used for image formation is detachably attached, the image forming system comprising:

a controller configured to control the image forming apparatus;

a detection unit configured to detect information about a used amount of the unit;

an output unit configured to output information indicating that the unit isrequired to be replaced when the information about the used amount reaches a first threshold, and a setting unit configured to, in a case where the unit is used after the information about the used amount reaches the first threshold and is replaced by a new unit, change the first threshold to a second threshold based on information about a used amount of the unit when the unit has been replaced by the new unit, the second threshold is larger than the first threshold, wherein image quality of an image formed on a recording material when the information about the used amount reaches the first threshold is different from image quality of an image formed on a recording material when the information about the used amount reaches the second threshold.

11. The image forming system according to claim 10, further comprising a storage unit configured to store, in association with one another, user information about a user who has used the unit, main body information of the image forming apparatus, and the information about the used amount of the unit, wherein the controller updates the main body information stored in the storage unit when the user information about the user who has used the unit is received from another image forming apparatus different from the image forming apparatus.

12. The image forming system according to claim 11, wherein the controller updates the main body information stored in the storage unit and transmits the information about the used amount of the unit to the another image forming apparatus.

13. The image forming system according to claim 10, wherein the setting unit sets, as the second threshold, the information about the used amount of the unit when the unit has been replaced by the new unit.

14. The image forming system according to claim 10, wherein the controller estimates a replacement time of a newly attached unit based on information about a plurality of used amounts when the unit is replaced a plurality of times.

15. The image forming system according to claim 10, wherein the information about the used amount is a drive time of the unit.

16. The image forming system according to claim 10, wherein the unit is a fixing unit for fixing an image formed on a recording medium.

17. The image forming system according to claim 10, wherein the unit is a cartridge including an image bearing member on which an image is to be formed.

18. The image forming system according to claim 10, wherein the image forming system further comprises a storage unit configured to accumulate and store the information about the used amount, wherein the controller deletes the information stored in the storage unit when the unit is replaced.

19. The image forming system according to claim 10, wherein the image quality of an image formed on a recording material when the information about the used amount reaches the first threshold corresponds to a graphic image and the image quality of an image formed on a recording material when the information about the used amount reaches the second threshold corresponds to a text image.

20. The image forming system according to claim 19, wherein the first threshold is a value that a density of the graphic image is changed, and the second threshold is a value that a density of the text image is changed.

* * * * *